United States Patent [19]

Weis et al.

[11] 4,048,758

[45] Sept. 20, 1977

[54] SAND-BLASTING MACHINE FOR CASTINGS

[75] Inventors: Martin Weis, Ettlingen; Adolf Scholz, Karlsruhe, both of Germany

[73] Assignee: Badische Maschinenfabrik GmbH, Germany

[21] Appl. No.: 705,244

[22] Filed: July 14, 1976

[30] Foreign Application Priority Data

July 23, 1975 Germany ..... 2532837

[51] Int. Cl.[2] ..... B24C 3/00

[52] U.S. Cl. ..... 51/416; 51/423

[58] Field of Search ..... 51/15, 14, 9; 269/57

[56] References Cited

U.S. PATENT DOCUMENTS

| | | | |
|---|---|---|---|
| 1,949,991 | 3/1934 | Challinor | 51/15 |
| 2,250,500 | 7/1941 | Rosenberger | 51/9 |

*Primary Examiner*—Al Lawrence Smith
*Assistant Examiner*—Robert C. Watson
*Attorney, Agent, or Firm*—Craig & Antonelli

[57] ABSTRACT

A machine for blasting workpieces (castings) comprises an arcuate cabin with successive working stations within it. Two conveying systems are provided — a central turntable with workpiece carriers which are rotatable about horizontal axes and extend into the cabin through a horizontal slot, and an overhead conveyor with workpiece reception hooks which extend through a slot in the roof of the cabin. The axes of the workpiece carriers on the turntable may be made capable of swivelling in a vertical plane. Various drive arrangements are described, including control by limit switches and a timing relay. Entry and exit lock chambers and door arrangements are described.

15 Claims, 2 Drawing Figures

SAND-BLASTING MACHINE FOR CASTINGS

The invention relates to a sand-blasting machine for castings as workpieces, the machine having a plurality of working stations which are arranged in a cabin and through which the workpieces pass in succession when the machine is in use.

The task of machines for blasting greatly varying kinds of workpieces with abrasives is to subject the workpieces to economical blasting in spite of the way in which the workpieces vary, for example in weight, shape and dimensions. In one proposal, two different workpiece transporting systems are arranged within a cleaning house, namely an overhead conveyor guided linearly over the roof of the said house for workpieces which are processed preferably in a suspended state or arranged in suspended baskets, and a double-rail track arranged at floor level, on which there runs a carriage having a turntable for large and heavy workpieces which cannot be suspended or which are too heavy for the overhead conveyor. These various workpiece carriers all rotate about a vertical axis.

Recently, however, it has been recognised that certain castings which comprise deep cavities or cavities with a small cross-section — more particularly, for example, engine cylinder heads and cylinder blocks — can be blasted with abrasives more advantageously when rotating about a horizontal axis, which on the one hand allows better access for the abrasives and on the other hand ensures that moulding sand and abrasives are always emptied out of such cavities. Therefore, in modern machines for workpieces of that kind the workpiece holders turn about a horizontal axis. Examples of this type of apparatus can be found in German Auslegeschrift 1,752,601, and our co-pending applications Ser. No. 666,417, filed March 12, 1976, entitled "Improved Blasting Apparatus." Such special machines have an extremely large processing capacity, but cannot be fully utilised in all cases. In a foundry naturally other kinds of workpiece also have to be dealt with and these may be more economically treated by rotating them about a vertical axis. In the state of the art known hitherto, two different machines had to be provided in order to meet these requirements.

The present invention has as its object to combine in a single machine the two optimum movement systems for workpieces, in the one case with rotation about a horizontal axis and in the other case with rotation about a vertical axis, while aiming to keep to a minimum the outlay required for conversion.

According to the present invention there is provided a sand-blasting machine for castings as workpieces, the machine having a plurality of working stations arranged in a cabin such that the workpieces pass through these stations in succession, wherein at least the cabin for the blasting stations is constructed in arcuate form, and in the centre of this arcuate cabin there is disposed a turntable with workpiece carriers which are capable of rotating about horizontal axes, extend outwards from the turntable and extend through the inner boundary wall of the arcuate cabin through a horizontal slot, while above the arcuate cabin there is provided an overhead conveyor which extends along a corresponding arcuate course and has workpiece reception hooks extending through a slot in the roof of the cabin.

A machine constructed with these features is intended more particularly for jobbing foundries which have a fluctuating work programme and have to expect changes in the programme at any time. Hitherto, foundries of this kind, if they wanted to achieve competitive deliveries of cylinder blocks or cylinder heads, had to obtain a special cleaning machine which was idle when there were no such orders, since it could not be used for other parts. With the new machine in accordance with the present invention, cylinder blocks and cylinder heads can be processed with the same quality and with the same economical advantage as on modern special machines; but the machine is also quite capable of being used for all other workpieces which are best dealt with in a hanging condition.

The spacing of the workpiece reception hooks on the overhead conveyor and the spacing of the workpiece carriers on the turntable may, with advantage, be the same, and the overhead conveyor and the turntable may, with advantage, have a common drive. The workpiece carriers at the turntable are preferably offset by half a spacing relatively to the workpiece reception hooks at the overhead conveyor; also preferably, the overhead conveyor and the turntable are synchronously driven. Thusit is possible to provide for both systems to be put into in operation at the same time, without the workpiece holders of the two systems disturbing one another or being subjected to the action of abrasives in an untimely manner. If the workpiece carriers on the turntable are not too large, it is even possible to dispense with any conversion.

A preferred embodiment of means for controlling the cycle of operations consists in providing operators, such as cams or dogs, on the turntable at a distance corresponding to the spacing of the workpiece carriers, these operators co-operating with two limit switches which are arranged at half spacing. The particular limit switch associated with the conveying means in use at the time — overhead conveyor or turntable as the case may be — is rendered operative.

If, on the other hand, two separate drives are provided for the overhead conveyor and the turntable, according to a feature of the invention it is proposed that the turntable with the workpiece carriers is adapted to be fixed at half the spacing of the blasting stations. More particularly if the workpiece carriers on the turntable are cages or baskets, it is also proposed that the workpiece carrier axes at the turntable are constructed to be capable of swivelling in a vertical plane, which makes onloading and offloading easier.

Further details of the invention will be found in the subsidiary claims in the set of claims appended hereto.

An embodiment of the invention will be described hereinafter, by way of example, with reference to the accompanying drawings wherein.

Figure 1:
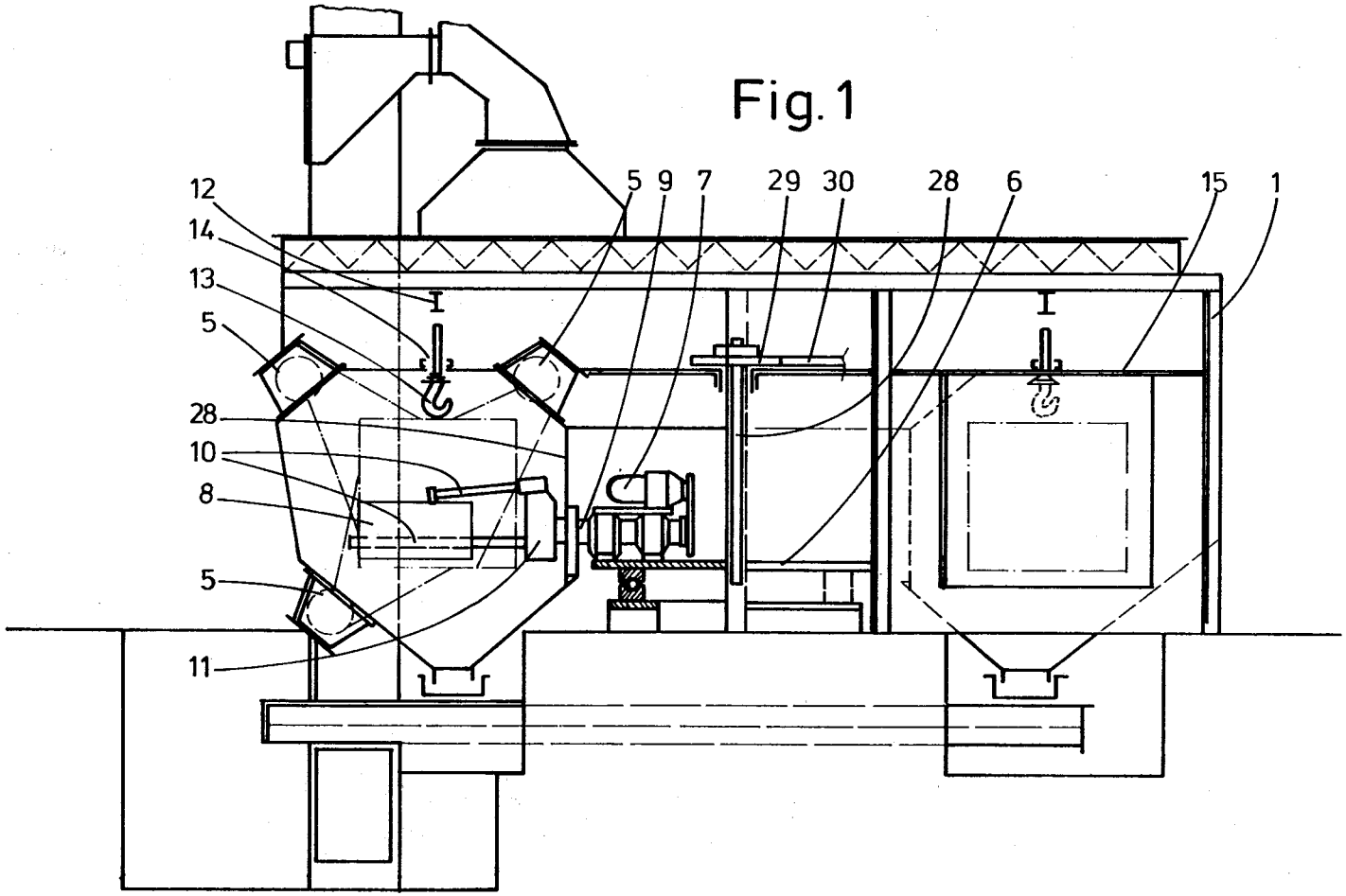
FIG. 1 shows a vertical section through a multipurpose blasting machine.
Figure 2:
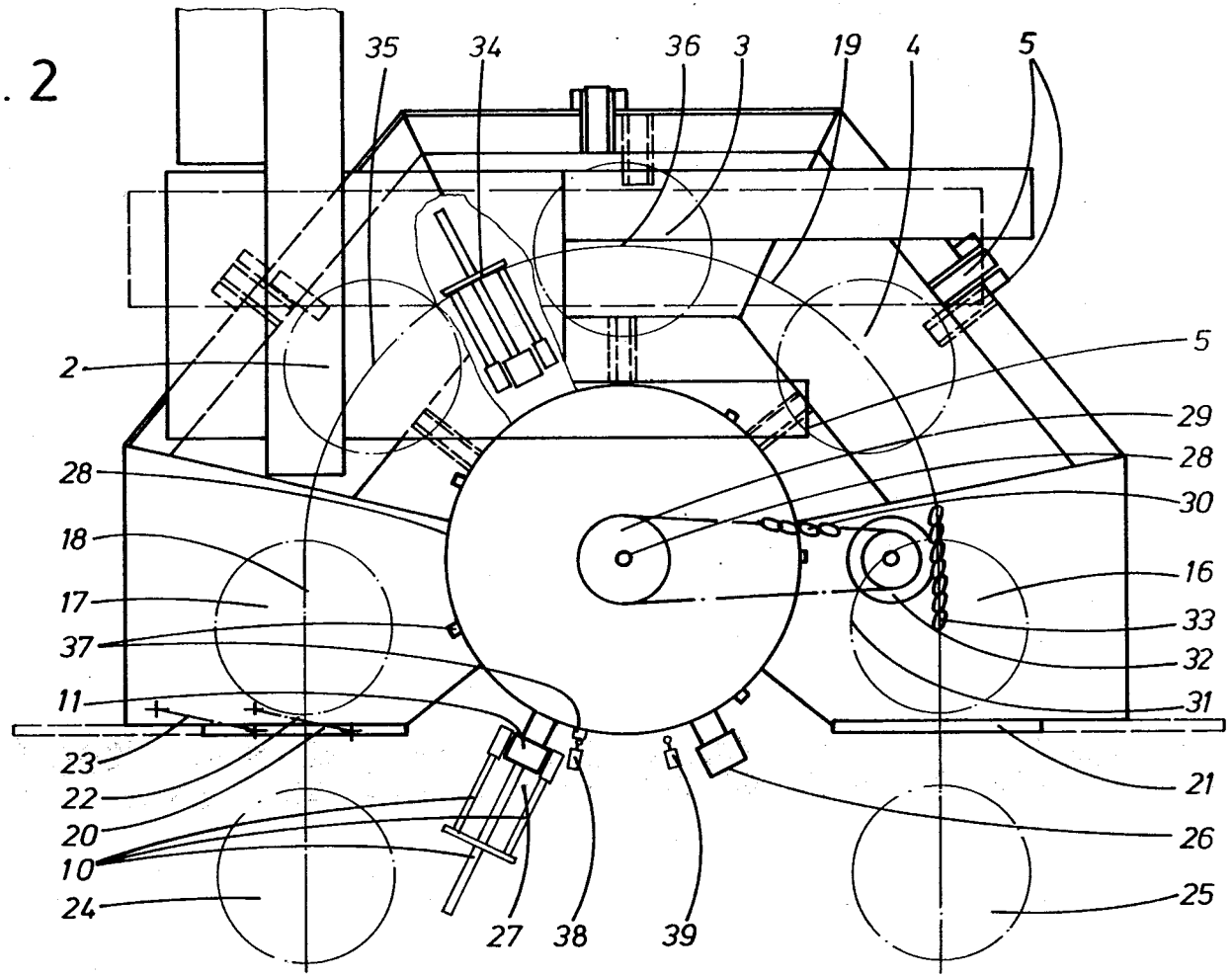
FIG. 2 shows a view of the machine from above.

A cabin 1 in the shape of part of a ring, in other words a substantially arcuate shape, is equipped with centrifuging wheels 5 at three blasting stations 2, 3 and 4. Disposed in the centre of the cabin 1 is a turntable 6 which comprises a plurality of drives 7, each of them for a workpiece carrier constructed here as a tongs 10, each said carrier being capable of rotating about a horizontal axis 9. Reference numeral 8 indicates a workpiece clamped by the tongs 10. The protruding portions of the tongs 10 are simple rods. A drive 11 is provided for opening and closing the tongs.

Above the arcuate cabin 1 there is arranged an overhead conveyor rail 12 with workpiece reception hooks 13 which extend downwards through a slot 14 in the roof 15 of the cabin 1.

The cabin 1 comprises, at both sides, tangentially situated extensions 18 where the overhead conveyor rail changes from the arcuate course to a rectilinear course. In these regions additional stations 16 and 17 are provided as lock or buffer chambers for preventing the escape of abrasives and for allowing emptying of the workpieces before further conveyance. Externally, the lock chambers 16, 17 of the cabin 1 are closed by doors 20 and 21 which are guided by parallel links 22 and 23, indicated in dot-dash lines, between the opening position and closed positions. Because of this linkage guiding arrangement the door when opening passes through only a minimum angle of arc so that it can be opened and closed without hindering the workpieces hanging on the workpiece reception hooks 13.

The onloading and offloading stations for operation with the overhead conveyor are given the reference numerals 24 and 25. The corresponding when the workpiece carriers are rotating baskets, the basket or its axis of rotation is swiveled in a vertical plane so that it may be loaded in an upper position and unloaded in a lower position (the workpiece falling out under the influence of its own weight). Since this design of loading and unloading swivel mechanism is known in the state of the art, the details of this mechanism will not be further described and are not illustrated in the drawings. stations for operation with the turntable are situated close to the stations 24 and 25 and are designated with the numberals 26 and 27. The conveying means bringing the workpieces to these stations and away from them are not shown in detail since they are of a conventional type.

The turntable 6, whose conventional drive is not illustrated, comprises an upwardly extended shaft 28 with a chain wheel 29 around which a chain 30 is taken. The chain 30 also embraces a chain wheel 31. Connected securely to the chain wheel 31 is a chain annulus 32 which engages the driving chain 33 of the overhead conveyor and drives the latter. The chain wheels 29 and 31 and chain annulus 32 are so selected that the turntable 6 and the overhead conveyor 13 runs synchronously. The connection provided by the chain 30 is also so arranged that the workpiece carriers 10, 34 of the turntable 6 are situated in the middle of the spacing between the workpiece reception hooks 35 and 36. The drive need not necessarily come from the turntable 6 but can also come from the overhead conveyor 12.

In the illustrated constructional example the control of the two conveying systems is so arranged that, at the periphery of the turntable 6, cams 37 are arranged in accordance with the number of the workpiece carriers 10, 34, co-operating with two stationary limit switches 38 and 39. The latter are arranged at a distance from one another corresponding to half the spacing of the workpiece carriers. Depending on which of the two conveying systems 6, 12 is loaded with workpieces, one or the other limit switch 38 or 29 is actuated and it stops the conveying system when the workpiece holder is situated at the middle of the working station; then after the period of operation of a timing relay, which is set in operation at the same time, the drive of the conveying system is started up again. Such controls are generally known and are not illustrated in the drawings. The cams 37 and limit switches 38 and 39 can of course also be arranged at any other point in the range of movement of one of the two conveying systems.

With synchronous operation of the turntable 6 and the overhead conveyor 12 there is no need for any conversion work when changing over from one of the conveying systems to the other. With separate drives for the turntable 6 and the overhead conveyer 12, on the other hand, the light rods 10 are removed and the turntable is fixed in position at half spacing when the overhead conveyor is to be operated. In this way it is ensured that the parts of the tongs drive 11 remaining at the turntable 6 are not situated in the blasting range of the centrifuging wheels 5.

What is claimed is:

1. A machine for blasting castings as workpieces, the machine comprising: a plurality of working stations including one or more blasting stations, said working stations being arranged in a cabin such that the workpieces pass through these stations in succession, wherein at least the part of the cabin for the blasting stations is constructed in arcuate form, a turntable disposed centrally with respect to the arcuate cabin part, workpiece carriers which are capable of rotating about horizontal axes being mounted on said turntable, and extending outwardly from the turntable through the inner boundary wall of the arcuate cabin through a horizontal slot, and an overhead conveyor positioned above the arcuate cabin part which extends along a corresponding arcuate course and has workpiece reception hooks extending through a slot in the roof of the cabin.

2. A blasting machine according to claim 1, wherein the workpiece reception hooks on the overhead conveyor and the workpiece carriers on the turntable are arranged at the same spacing.

3. A blasting machine according to claim 1, including a common drive for both the overhead conveyor and the turntable.

4. A blasting machine according to claim 2, wherein the workpiece carriers on the turntable are offset relatively to the workpiece reception hooks on the overhead conveyor to the extent of half the said spacing.

5. A blasting machine according to claim 1, including means whereby the turntable and the overhead conveyor are synchronously driven.

6. A blasting machine according to claim 1, wherein operators for controlling the working cycle of one or the other of the turntable and overhead conveyor are provided at the turntable, the said operators being arranged at an interval corresponding to a full spacing between the workpiece carriers or the workpiece reception hooks, as the case may be, and co-operating with two limit switches which are arranged at half the said spacing and are associated with the turntable and overhead conveyor respectively, the particular limit switch associated with the conveying system in use, overhead conveyor or turntable as the case may be, being rendered operative when that system is to be used, and a timing relay is provided for controlling the standstill period during which the workpiece is blasted with abrasive.

7. A blasting machine according to claim 1, including separate drive means for the overhead conveyor and the turntable, wherein means are provided for fixing the turntable stationary with the workpiece carriers half way between the blasting stations.

8. A blasting machine according to claim 1, wherein the workpiece carriers on the turntable are constructed as tongs, cages, or baskets.

9. A blasting machine according to claim 1, wherein those parts of the workpiece carriers which project into the cabin are constructed so that they can easily be detached.

10. A blasting machine according to claim 1, wherein the axes of the workpiece carriers on the turntable are constructed to be capable of swivelling in a vertical plane.

11. A blasting machine according to claim 1, wherein a tangentially adjoining extension is provided on each end of the arcuate cabin.

12. A blasting machine according to claim 1, wherein first and last stations of the cabin are constructed as entry and exit lock chambers respectively.

13. A blasting machine according to claim 1, wherein first and last stations of the cabin comprise a door closure arrangement.

14. A blasting machine according to claim 13, wherein the door closure arrangement is a plate provided with sealing elements, the said plate being capable of pivoting on two parallel links.

15. A blasting machine according to claim 1, wherein stations constructed for workpiece onloading and offloading are positioned outside the cabin.

* * * * *